US010265600B2

(12) United States Patent
Jansen et al.

(10) Patent No.: US 10,265,600 B2
(45) Date of Patent: Apr. 23, 2019

(54) SAFETY SHUTOFF FOR EXERCISE EQUIPMENT

(71) Applicant: True Fitness Technology, Inc., O'Fallon, MO (US)

(72) Inventors: Nicholas J. Jansen, O'Fallon, MO (US); Dennis L. Meyerotto, St. Charles, MO (US); Jared M. Kueker, St. Charles, MO (US); Bob J. Hawthorne, Troy, IL (US); David L. Green, St. Charles, MO (US); Tom A. Russo, St. Charles, MO (US)

(73) Assignee: True Fitness Technology, Inc., O'Fallon, MO (US)

( * ) Notice: Subject to any disclaimer, the term of this patent is extended or adjusted under 35 U.S.C. 154(b) by 0 days.

(21) Appl. No.: 15/430,124

(22) Filed: Feb. 10, 2017

(65) Prior Publication Data

US 2017/0225055 A1 Aug. 10, 2017

Related U.S. Application Data

(60) Provisional application No. 62/293,602, filed on Feb. 10, 2016.

(51) Int. Cl.

| | |
|---|---|
| ***A63B 24/00*** | (2006.01) |
| ***A63B 71/00*** | (2006.01) |
| ***A63B 22/02*** | (2006.01) |

(52) U.S. Cl.

CPC ..... *A63B 71/0054* (2013.01); *A63B 22/0235* (2013.01); *A63B 24/0087* (2013.01); *A63B 2071/0081* (2013.01)

(58) Field of Classification Search

CPC ..... A63B 71/0054; A63B 22/0235; A63B 24/0087; A63B 2071/0081

See application file for complete search history.

(56) References Cited

U.S. PATENT DOCUMENTS

| | | | | |
|---|---|---|---|---|
| 5,645,509 | A * | 7/1997 | Brewer | A63B 22/02 379/106.01 |
| 7,153,241 | B2 * | 12/2006 | Wang | A63B 22/0242 482/54 |
| 8,118,711 | B2 * | 2/2012 | Chen | A63B 71/0054 482/1 |
| 8,986,165 | B2 * | 3/2015 | Ashby | A63B 24/0087 482/1 |
| 2005/0272565 | A1 | 12/2005 | Hao | |
| 2006/0009333 | A1 | 1/2006 | Wang | |
| 2009/0054208 | A1 | 2/2009 | Wu | |
| 2010/0248898 | A1 | 9/2010 | Chen | |
| 2013/0237374 | A1 | 9/2013 | Ashby | |

OTHER PUBLICATIONS

International Search Report, International Patent Application No. PCT/US2017/017484, dated Apr. 20, 2017 (10 pages).

* cited by examiner

*Primary Examiner* — Glenn Richman

(74) *Attorney, Agent, or Firm* — Lewis Rice LLC

(57) ABSTRACT

A pull cord safety system, primarily for use with an exercise device such as, but not limited to, a treadmill, that provides for a captive cord which is fixed to the exercise device via a trip mechanism housing. This provides for the benefits of a pull cord safety shutoff where the treadmill shuts off if sufficient force is applied to pull the cord, but keeps the system from being a separable key system. Thus, it eliminates misplacing the key and provides for a system which can more easily be triggered regardless of the angle of fall or instability.

10 Claims, 8 Drawing Sheets

SAFETY SHUTOFF FOR EXERCISE EQUIPMENT

CROSS REFERENCE TO RELATED APPLICATION(S)

This application claims the benefit of U.S. Provisional Patent Application Ser. No. 62/293,602, filed Feb. 10, 2016, the entire disclosure of which is herein incorporated by reference.

BACKGROUND

1. Field of the Invention

This disclosure relates to the field of safety mechanisms for aerobic or cardiovascular exercise machines. In particular, to pull cord safety mechanisms for shutting off an exercise machine that utilize a captive cord.

2. Description of the Related Art

The benefits of regular aerobic exercise on individuals of any age are well documented in fitness science. Aerobic exercise can dramatically improve cardiac stamina and function, as well as lead to weight loss, increased metabolism, and other benefits. At the same time, aerobic exercise has often been linked to damaging effects, particularly to joints or similar structures, where the impact from many aerobic exercise activities can cause injury. Therefore, those involved in the exercise industry are continuously seeking ways to provide users with exercises that have all the benefits of aerobic exercise, without the damaging side effects.

In order to provide lower impact exercise, many individuals work out using an exercise machine. These machines have a number of advantages for performing exercise. In a first instance, they allow for aerobic exercise to be performed indoors in a relatively small space. They can also provide for an aerobic exercise with less damaging side effects. For example, in walking or running the impact of the person's foot with the surface produced by running on a road can be reduced by exercising on a treadmill. The treadbase of a treadmill can be purposefully engineered to absorb and reduce impact from footfalls, making the motion produce less impact on the body than a hard surface such as asphalt.

While the benefits of low impact exercise can be seen on a treadmill, they can be seen even more dramatically when other types of aerobic exercise machines are considered. Many types of machines, such as elliptical trainers, provide for a very low-impact exercise because they allow for the user to exercise using a motion which is not obtainable outside the machine and which is very low impact as it is a smooth motion with little to no impact ever occurring. The motion of these machines can be considered more beneficial than more traditional exercises in many respects, but the comparison is not really apt as the standing foot "pedaling" motion of an elliptical trainer is a motion that requires a machine to perform. This motion cannot be performed without benefit of a machine as the motion is not a "natural" motion, even though it is one that is comfortable to perform. Thus, the machine actually provides a completely new form of exercise unobtainable elsewhere.

Virtually all modern cardiovascular exercise machines produce exercise through the use of mechanical drive and/or resistance mechanisms and the vast majority include electric motors to produce some form of motion or resistance. For example, a modern treadmill will generally provide a motor to power a belt that produces a moving surface upon which the user "runs in place" to carry out the exercise. Even machines which do not include motors, often utilize mechanical constructs (such as brakes) controlled by control electronics to provide resistance to the user to make the exercise sufficiently difficult. Many also utilize mechanical, pneumatic, hydraulic or other components to produce incline. Exercise machines typically have a plethora of parts that are designed to move when the user is exercising. As such, exercise machines usually have a lot of powered moving parts when in use.

While this type of mechanical structure provides most of the benefit of an exercise machine, it can also present safety concerns. A motorized treadmill will move the belt whether or not a user is moving on it and should the user's motion cease, the movement of the belt can serve to push them (often quite rapidly) off the back of the treadbase. Safety concerns with exercise machines particularly relate to concerns when a user is using the machine and something happens so that their interaction with the machine changes. The biggest concern is the user becoming unstable on the machine and falling. In treadmills, for example, a user could land badly on a single step causing them to lose their balance and not be able to keep up with the moving belt for simply a matter of seconds. At high speed, continued belt movement can then cause them to fall or to be pushed off the machine or into its moving parts in a matter of seconds. Because of these problems, the vast majority of exercise machines (like most large electromechanical devices) provide an emergency electricity shutoff.

In exercise machines, the emergency shutoff is traditionally of one of two forms. Some exercise machines, like many industrial manufacturing machines, provide for a large emergency shutoff button. While this can be an effective mechanism, an emergency shutoff button is problematic for an exercise machine as the need for a shutoff will generally relate to a user being off-balance and moving in a somewhat uncontrolled fashion which can make it difficult for them to reach or activate the button in the short time before injury is potentially inflicted. They can also be out of range of the button due to the issue creating the safety concern. Because of this, most exercise machines usually utilize a shutoff key and pull cord.

A traditional shutoff key generally comprises a thin plastic wafer or other "key" which is slotted into a mating slot on the front panel of the exercise device and held in place by friction. When slotted, the key serves to move internal components of the treadmill which then creates an electric circuit between the electrical source, motor, and other electromechanical devices on the exercise device. Thus, the exercise device is "powered" when the key is in position in the slot as the electrical circuit from the power source (generally a wall outlet) to the motor and other electrically driven or controlled components is completed. The key is attached to a cord which is, in turn, connected to a clothing clip.

To use the exercise device, the user slides the key into the complimentary slot in the exercise device. When the key is so slotted, the exercise device has a complete circuit and is allowed to be powered. The user then is supposed to attach the clothing clip to their clothing and commences their exercise in a standard fashion. Because of the cord connection, should a user move away from the key slot further than the length of cord, their movement will generally overcome the inherent friction and pull the key from the exercise device. Removal of the key immediately breaks the electrical connections in the exercise device and forces it to shut off as the motor and other components immediately lose electric power.

As the key slots are generally positioned toward the front of the exercise device, a movement which will result in the cord being pulled is generally indicative of a person falling, moving backward, or otherwise not staying in the equilibrium position where the exercise is performed. Thus, should the user begin to fall, the machine will shut off and while the user may still fall (or may regain their balance) they will not fall into an operating machine.

Most safety keys are very simple and generally comprise a simple plastic shape that pushes two internal components into electrical connection internal to the machine, more advanced ideas have been proposed such as those described in U.S. Pat. Nos. 8,986,165 and 8,118,711, and United States Published Application 2009/0054208 the entire disclosures of which are herein incorporated by reference. Most traditional safety keys are not themselves conductive to avoid any need of electricity to pass through them, and they instead will mechanically move components internal to the control systems of the exercise device into electrical contact to complete the circuit. Even advanced safety keys, however, like all pull cord safety keys, suffer from certain similar problems.

In the first instance, the safety keys can get lost because they are separate components from the exercise machine itself. This can be frustrating to a user and can be a large problem at facilities such as gyms where multiple users share machines. It often means that people will commonly leave the key in the slot with the cord hanging loosely when they are done using the machine to avoid losing the key and not being able to operate the treadmill in the future. Some facilities will even tape or otherwise secure the keys so they cannot be easily removed. From this, it is easy for the user (or a new user) to simply forget to attach the cable to their clothing when the get on the treadmill because the key is generally not a particularly visually apparent object and the exercise machine is already in its powered state when the user arrives at it.

Further, many exercise machines utilize the key as their primary power switch with a main power switch, if present at all, being in a much less convenient location such as near the floor. Thus, a user leaving the key in the slot results in the exercise machine consuming unnecessary power as electronics remain powered up even when not in use. Instead, it is generally desirable for each user to remove the key after they are done using the exercise machine and place it in a convenient location. This insures that the next user must handle and insert the key both saving power in the interim and forcing the new user to handle the key reminding them they should attach the cord clip to their clothing before using the exercise machine.

Secondly, in order to allow the key to safely reach electrical components inside the control panel of the exercise machine while simultaneously avoiding a user being able to touch the electronic components or force another object into the key slot, many safety keys are actually quite long and are commonly generally rectilinear in shape. This shape means that there can be substantial friction and other problems to pull the key from the slot if it is being pulled at any angle other than essentially straight out. For example, most keys cannot be pulled from the slot by pulling the cord at an angle generally 90 degrees to the primary axis of the key in any dimension. As a fall or unbalancing event can readily cause the user to move in a direction that is not straight back and is often downward (which is generally around 90 degrees to the position of the key when inserted), in certain fall events the clothing clip can actually be pulled from the user's clothing more easily than the key can be pulled from the slot which results in the machine not shutting off and the safety key not meeting its intended purpose.

SUMMARY

Because of these and other problems in the art, described herein is a pull cord safety system, primarily for use with an exercise device such as, but not limited to, a treadmill, that provides for a captive cord which is fixed to the exercise device via a trip mechanism housing. This provides for the benefits of a pull cord safety shutoff where the exercise device shuts off if sufficient force is applied to pull the cord, but keeps the system from being a separable key system. Thus, it eliminates misplacing the key and provides for a system which can more easily be triggered regardless of the angle of fall or instability.

Described herein, among other things, is an electrical shutoff for an exercise device, the shutoff comprising: a main body attached to the exercise device; a flexible cord attached to a peg at a first end and a clip at an opposing end; a shuttle attached to the peg; an electrically conductive shunt attached to the shuttle; an indicator attached to the shuttle and including a ring; a button attached to the main body via a spring, the spring biasing the button to a biased position relative to the main body, the button also having a constrained area of movement from the biased position relative to the main body; and at least two electrically conductive clips; wherein, in a power position, the shunt in placed in electrical contact with the at least two clips so that the shunt completes an electric circuit between the two clips; wherein, pulling the cord when the shutoff is in the power position, causes the peg to move in a first direction relative to the main body, which in turn causes the shuttle, the shunt, and the indicator to also move in the first direction relative to the main body a sufficient distance to break the electric circuit between the two clips and place the shutoff in a tripped position but without separating the peg, the shuttle, the shunt, and the indicator from the main body; wherein, when the shutoff is in the tripped position, the ring obscures at least a portion of the button; wherein, to return the shutoff to the power position from the tripped position, the button is pushed against the spring from the biased position to another position within the constrained area of movement which causes the shuttle, the peg, the shunt, and the indicator to move in a direction opposite the first direction relative to the main body and returns the shunt to completing the electric circuit between the at least two clips; and wherein, after the pushing is complete, the spring biases the button back to the biased position without breaking the electrical connection between the at least two clips.

There is also described herein, in an embodiment, an electrical shutoff for an exercise device, the shutoff comprising: a main body attached to the exercise device; a flexible cord attached to a peg at a first end and a clip at an opposing end; a shuttle attached to the peg; an electrically conductive shunt attached to the shuttle; an indicator attached to the shuttle and including a ring; a shaft attached to the main body; and at least two electrically conductive clips; wherein, in a power position, the shunt in placed in electrical contact with the at least two clips so that the shunt completes an electric circuit between the two clips; wherein, pulling the cord when the shutoff is in the power position, causes the peg to move in a first direction relative to the main body, which in turn causes the shuttle, the shunt, and the indicator to also move in the first direction relative to the main body a sufficient distance to break the electric circuit between the two clips and place the shutoff in a tripped position but without separating the peg, the shuttle, the shunt, and the indicator from the main body; wherein, when the shutoff is in the tripped position, the ring obscures at least a portion of the shaft; and wherein, to return the shutoff to the power position from the tripped position, the ring is pushed in a direction opposite to the first direction which causes the shuttle, the peg, the shunt, and the indicator to move in a direction opposite the first direction relative to the main body and returns the shunt to completing the electric circuit between the at least two clips.

There is also described herein a shutoff of the above embodiments wherein the ring obscures a side of the button or shaft.

There is also described herein a shutoff of the above embodiments wherein the ring is a different color to the button or shaft.

There is also described herein a shutoff of the above embodiments wherein the exercise device is a treadmill.

There is also described herein a shutoff of the above embodiments wherein the clip is configured to attach to clothes.

DESCRIPTION OF PREFERRED EMBODIMENT(S)

Figure 1:
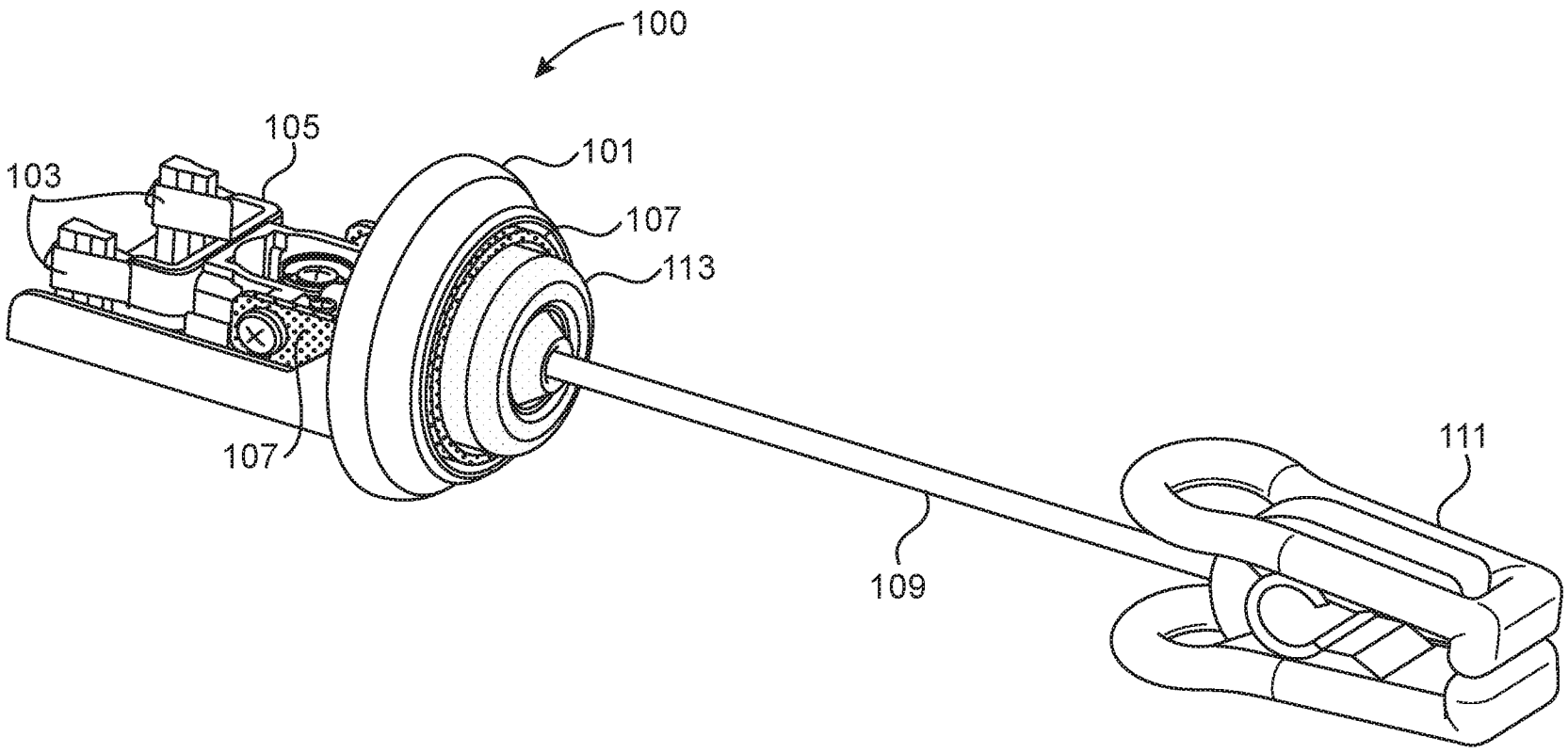
FIG. 1 shows a front perspective view of a first embodiment of a captive cord safety mechanism separated from an exercise device.

The attached FIGS. provide for two different embodiments of a fixed pull cord safety system for use in conjunction with an exercise device. The exercise device will typically be a powered treadmill which utilizes an electrical power cord to connect to a wall outlet to provide electricity to the device, but this is by no means required and the system may be used on any exercise device where an emergency power shutoff that results from a pull cord activation is desired. This includes, but is not limited to, treadmills, elliptical trainers, stairmills, and ladder climbers. The embodiments of the safety system provided herein are not intended to be exhaustive, but are illustrative as to how the general operation and teaching of the present disclosure can be put into practice.

The safety shutoff mechanisms (100) shown in the embodiments of the FIGS. are shown separated from an exercise device so as to show the operation of the safety mechanism. However, a user should recognize that the main body portion (101) of the shutoff mechanism (100) would generally be mounted to the exercise device in a manner where it is not intended to be removed in normal operation of the exercise device, including when carrying out the emergency shutoff for which it is built. Generally, the main body (101) will be mounted so that the internal mechanisms of the shutoff (100) are internal to the frame or cover of the exercise device.

Figure 4:
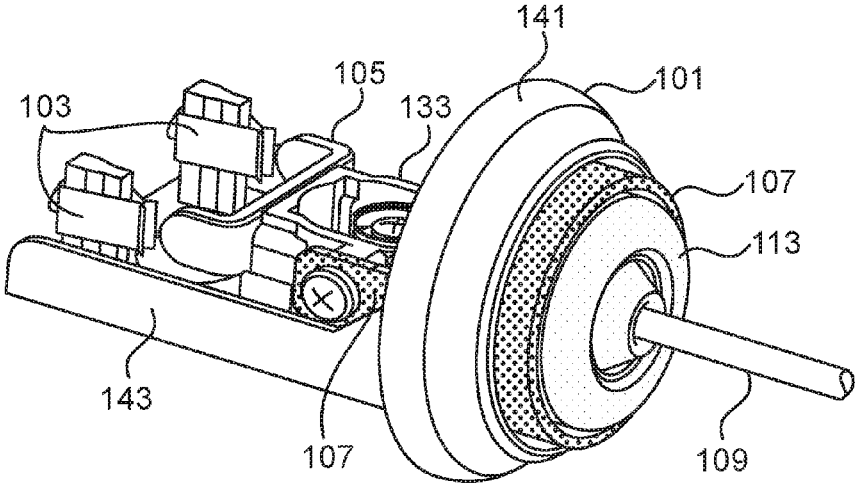
FIG. 4 shows a front perspective view of the electrical trip mechanism of FIG. 3 illustrating the position of the trip ring obscuring a portion of the button.
Figure 10:
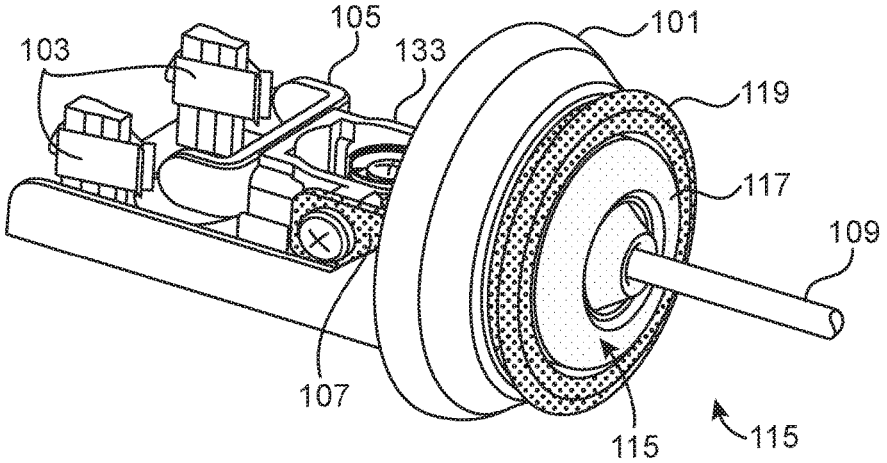
FIG. 10 shows a front perspective view of the electrical trip mechanism FIG. 9 illustrating the position of the trip ring obscuring a portion of the shaft.

In the depicted embodiments, the main body (101) is provided with a generally mushroom-like shape having a circular flared head (141) extending from a more rectilinear tray stem (143). The flared head (141) will generally be positioned roughly adjacent an external casing of the exercise machine so that the tray stem (143) is internal to the structure of the exercise machine. Generally, the tray stem (143) will be internal to a control panel. Thus, a user will be able to see the flared head (141) of the main body (101) and the button (113) as generally shown in the view of FIG. 4. In the second embodiment, they could see the flared head (141) and shaft (117) as generally shown in FIG. 10. Depending on the position of the ring (107), at least some of the ring (107) will also generally be visible and the ring (107) will generally be positioned to obscure at least a portion of the button (113) or shaft (117) when the shutoff (100) is in the tripped position.

As opposed to prior designs, the main body (101) of the shutoff (100) does not comprise a "key" which would be slotted in the exercise machine, but is instead generally permanently attached to the exercise device and includes internal breaker mechanisms that allow internal components to move relative to each other without the main body (101) moving relative to the exercise device. The shutoff (100) will generally be mounted in a control panel or other convenient location on the exercise device. This will typically result in the button (113) or shaft (117) and other visible components being directly in front of the user, and commonly at a convenient height to be accessed. This is often around the average user's waist when standing on a treadmill.

It should be recognized, by one of ordinary skill, that in an alternative embodiment, the shutoff system (100) could be positioned anywhere convenient where the cord (109) will be pulled if the user moves in a way indicative of a fall or other situation where power cutoff to the exercise machine's moving components is desired. In an alternative embodiment, the main body (101) could additionally be used as a secondary key to provide a secondary trip, if desired, by removal of the whole safety mechanism (100) from the exercise machine. This may be valuable if different types of user falls were expected and different types of mechanical or electrical shutoff were desired to respond to them.

It should be recognized that this disclosure will often refer to electrical power being cutoff to the exercise machine when the shutoff (100) is tripped. In a strict sense, the electrical power to the exercise machine would only be cutoff completely if the machine's power plug was separated from the outlet, the flow of electricity to the outlet was stopped, or a breaker somewhere prior to the plug connection to the exercise machine was tripped. However this language is used herein because exercise devices are typically wired in a fashion that removal of a traditional safety key would cutoff electrical flow to all or most electrically driven components of the exercise machine from which a user could be likely injured and those of ordinary skill in the art understand that this effectively removes power from the exercise machine in the same manner as a traditional power switch.

In the embodiments of the FIGS., there are provided two generally similar structures which provide for different reset operations. A first embodiment is provided in FIGS. 1 through 6 while the second is shown in FIGS. 7 through 12. However, both embodiments include a number of common structures, operate generally along similar principles, and will often be discussed together. Specifically, in both embodiments the safety shutoff device (100) comprises a main body (101) housing an electrical circuit breaker or break switch comprising two electrically conductive spring connectors (103) and a connecting shunt (105) which is also electrically conductive that can be used to complete a circuit between the two spring connectors (103). The inclusion of two or more connectors (103) is not strictly required, but having an even number can provide symmetry to the shutoff (100) which can be desirable.

The shunt (105) is attached to a shuttle (133) which is mechanically connected to an attached string or flexible cord (109) via a bullet or peg (129). The shuttle (133) is also attached to an indicator (107) via the legs (171) of the indicator (107). As should be apparent from the drawings, in the depicted embodiment, the shuttle (133) is connected to connecting shunt (105) and the indicator (107) via screws and while this provides for a simple arrangement, it is by no means required. In alternative embodiments, the structures can be co-molded, formed as a single piece, adhered via adhesives, or attached together in any other manner understood by one of ordinary skill in the art to be generally strong and intended to be permanent.

The opposing end of the cord (109) from the peg (129) is attached to a clip (l 11) or other fastener for attaching the cord (109) to a user's clothing or otherwise to the user. The clip (111) may be of any type or format and is designed to link the cord (109) to the user. In this way, should the user move a greater distance from the body (101) than the length of the cord (109), the cord (109) will be pulled away from the body and the "trip" operation discussed below will occur. The clip (l 1) will generally be designed to provide a temporary connection so it can be used by multiple users. However, the force of connection between the clip (111) and the clothing and/or user needs to be sufficient that the cord (109) pulls the peg (129) to the forward trip position before the clip (111) would separate from the user in most cases.

It should be recognized that the term "pulled" in accordance with the cord (109) does not imply a specific direction of pull, only that the flexible cord (109) is tensioned by the act of pulling and, therefore, pulling on the clip (111) end of the cord (109) will generally cause the peg (129) at the opposing end to also have a force placed on it from the cord (109). This force will then generally cause the peg (129) to move as contemplated below.

The shuttle (133) is attached to the peg (129) in the depicted embodiment via a caged tongue (191) and grove (193) arrangement whereby the tongue (191) of the peg (129) is held within a corresponding groove (193) in the shuttle (133). This arrangement may allow for slight movement of the peg (129) relative to the shuttle (133) in certain dimensions, while causing the two elements to generally move as a single unit in others. In particular, in the depicted embodiment, the peg (129) can generally rotate about its central axis without moving the shuttle (133), but cannot move linearly more than a very small distance along its axis without similarly moving the shuttle (133) linearly in a generally co-linear direction.

In the first embodiment of the safety shutoff mechanism (100) shown in FIGS. 1-6, the shutoff (100) is designed to provide for large manual reset button (113) for ease of returning a tripped safety device (100) into mechanical operation. As can be best seen in the depiction of FIG. 4, the reset button (113) comprises the majority of the front face of the device (100) as visible to the user. The reset button (113) is generally provided in a partially floating position relative the main body (101) and allowed constrained movement within the main body (101).

In particular, the reset button (113) is inhibited from motion in a first direction beyond a biased position by the interface of tabs (311) with a mounting block (313) which is generally a portion of the main body (101) and cannot move relative to the main body (101). The tabs (311) allow for the reset button (113) to move backward (or into the main body (101)) from the biased position and within a certain area of movement, but do not allow it to move forward of the biased position (or out of the main body (101)). The biased position is referred to as such since there is a biasing mechanism, such as, but not limited to, a coil spring (131), which serves to push the reset button (113) forward to the biased position where the tabs (311) contact the mounting block (313) when no external force acts on the button (113).

In operation to shutoff an exercise device, the safety shutoff mechanism (100) would be mounted so that electrical power to the exercise device, or components of the exercise device whose emergency shutoff is desired, is routed through the connector clips (103) and the shunt (105). Thus, if the shunt (105) is in contact with the connector clips (103) an electric circuit between the connector clips (103) is completed and electricity is allowed to flow to powered components (if the exercise device is otherwise connected to a power source and any other power switches are engaged to an "on" position). Similarly, if the shunt (105) is not in contact with the connector clips (103), electrical flow is cut off at the clip (103) connected to the electrical source (e.g. wall outlet) and the other clip (103) has no electrical contact with an electric source. The first position, is generally referred to herein as the "power" position while the second is the "tripped" position.

The use of a shunt (105) and clip (103) arrangement is not necessary to build an electric breaker within the main body (101) and in other embodiments other electromechanical breakers of different design but similar effect may be used as would be understood by one of ordinary skill. For example, the shunt (105) and clips (103) may be replaced by a draw bridge type structure where a portion of the electrical connection moved with the shuttle (133) or where two pieces of the connection bend relative to each other to disconnect them. However, the shunt (105) and clip (103) design is generally preferred for a number of reasons. In the first instance, the friction between the clips (103) and the shunt (105) when the shunt (105) is placed in the power position generally provides some resistance to the shuttle (133) moving forward due to vibration of the exercise machine and the electrical connection being inadvertently disconnected.

Secondly, because of the spring design of the clips (103), once the shunt (105) is pulled past the point of direct contact (where the jaws of the clip (103) are closest together) the structure of the clip (103) will serve to push the shunt (105) forward as the jaws spring closed. This provides additional force to move the shunt (105) away from the clips and to make sure the electrical connection is cleanly broken even if the cord (109) is no longer being pulled. This can help avoid potential concerns from internal friction of the safety device (100) allowing the electrical contact to be maintained in certain cord (109) pull scenarios.

The safety shutoff system (100) is designed to be effectively permanently mounted to the exercise device in the preferred embodiment so the main body (101) would generally be a part of the exercise device's control panel or similarly situated. In the depicted embodiment, mounting of the safety device (100) to the exercise device is accomplished through a mounting screw (137) or similar device. As should be apparent, the captive cord (109) is arranged so as to be generally permanently mounted to the peg (129) such as via an adhesive or by being molded into the structure of the peg (129). Thus, the cord (109) would generally always be attached to the exercise machine in normal operation and is consider captive to the shutoff (100) and exercise machine.

In operation, generally, when a first user completes their exercise, they would pull the cord (109) to trip the safety shutoff device (100) which powers the exercise device down by generally disconnecting power to its major components. As should be apparent, pulling the cord (109) will result in the movement of the peg (129) and shuttle (133) outward of the main body (101) and that the movement of the peg (129) will generally occur regardless of the direction the cord (109) is pulled. Movement of the peg (129) in turn causes the shunt (105) to move to the position of FIGS. 3, 4, and 6 which show the tripped position with the shunt (105) electrically disconnected from the clips (103). Further, movement of the shuttle (133) also causes the indicator (107) to be moved forward. The ring (173) on the indicator (107) then will at least partially obscure at least a portion of the button (113). In the depicted embodiment, it generally covers the sides of the visible portion of the button (113).

Often, the ring (107) will be of a color to be readily seen and commonly indicative of a "stop" or "warning" such as, but not limited to, red or yellow and may also include words of warning. As can be best seen in FIG. 4, this makes the user visible portion of the safety shutoff device (101) appear strongly in this noticeable "warning" color due to the ring (107) at least partially obscuring the button (113). Thus, a user is generally quickly notified upon sight that the shutoff (100) in the exercise machine is in the tripped state.

When a new user comes to the exercise machine (or the first user returns) they would need to reset the safety shutoff device (100) to operate the exercise machine. By forcing the user to interact with the safety shutoff (100) to use the exercise machine, this hopefully triggers the user to attach the clip (111) to their clothing at the same time.

To return the safety device (100) to the operational or power state, in the embodiment of FIGS. 1 through 6, the user will push the button (113). As should be apparent from the review of FIGS. 5 and 6, depressing the button (113) in the trip state will cause the button (113) to mechanically contact the shuttle (133) and push the shuttle (133), peg (129), indicator (107) and shunt (105) backward relative the main body (101). Once pushed back a sufficient distance, the shunt (105) will engage the clips (103) by having the shunt (105) push open the jaws of the clips (103) and, so long as pushed a sufficient distance, frictionally engage the jaws to complete the electrical circuit between the clips (103).

Figure 2:
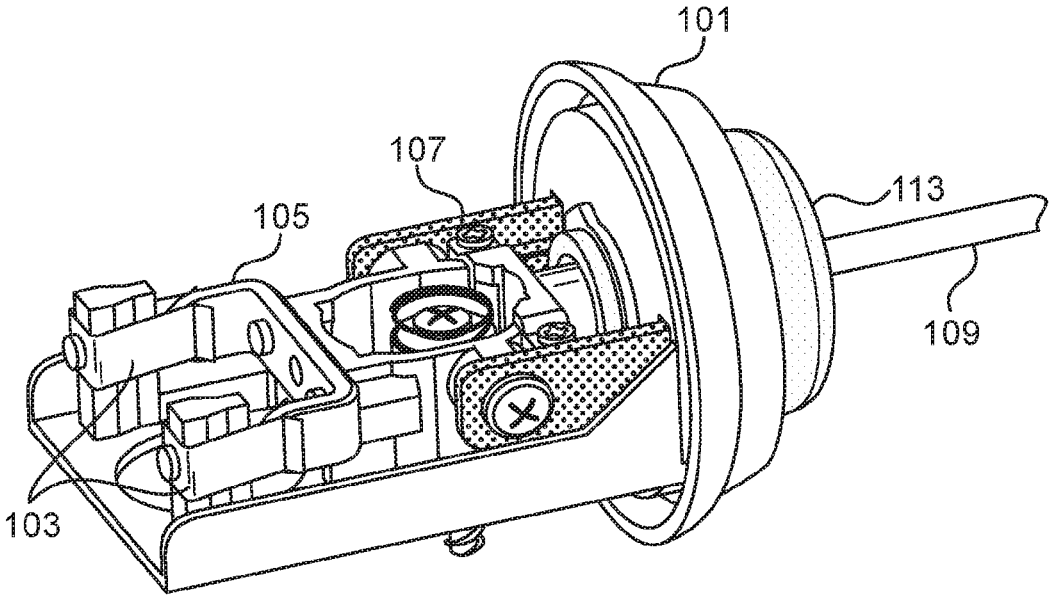
FIG. 2 shows a side perspective view of the electrical trip mechanism of FIG. 1 in the closed (power) position.
Figure 3:
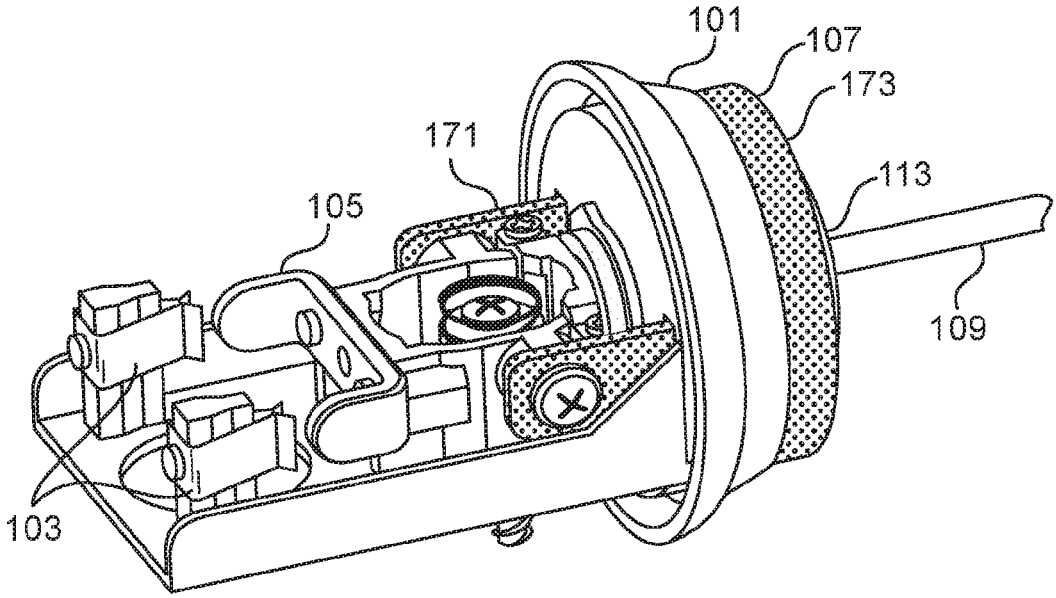
FIG. 3 shows a side perspective view of the electrical trip mechanism of FIG. 1 in the tripped (no power) position.
Figure 5:
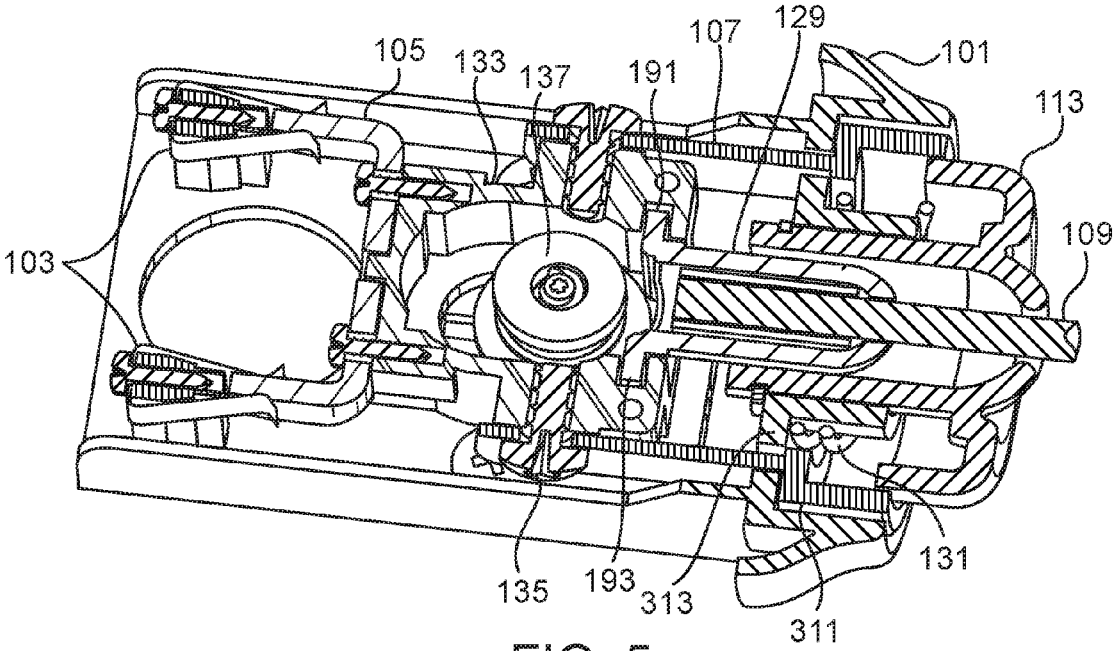
FIG. 5 shows a top cutaway view of the electrical trip mechanism of FIG. 2.

As soon as the user releases the button (113), the spring (131) will cause the button (113) to return to the biased position due to biasing as best shown in FIGS. 2 and 5. The button (113) will commonly be colored in a fashion to either make it less noticeable than the ring (107) or in a color which commonly indicates "safe" or "go" such as green. This color may be confined to the sides and not on the face (115) in order to make the color only visible when the indicator (107) is not extended and not obscuring the button (113). Upon return of the button (113) to the biased position, so long as sufficient force was applied to the button (113) to reengage the shunt (105) in the clips (103), the safety shutoff system (100) is now in the power position of FIGS. 1, 2 and 5, and the exercise device is ready for use.

If while exercising on the exercise machine, the user suffers an event which pulls the cord (109) (e.g. if they fall with the clip (111) attached to their clothing, or they grasp and pull the cord (109) due to a safety concern), the safety shutoff device (100) will move from the power to the trip state as the cord (109) pulls the peg (129) and shuttle (133) forward and, thus, the shunt (105) is pulled out of the clips (103) breaking the electrical circuit. This would immediately cutoff electric power forcing electrically powered components of the exercise machine to stop quickly. The indicator (107) will also again be moved to indicate the tripped position by at least partially obscuring the button (113).

It should be apparent that given the shape of the peg (129) and the connection between the cord (109) and peg (129), the cord (109) can be pulled at virtually any angle from the clip (111) end, including back toward the safety device (100), and the peg (129) will still move forward. This provides for a wide range of possible events that can trip the safety shutoff system (100).

Once everything is safe, the user can reactivate the exercise machine by resetting the button (113) in the same manner as discussed above. Again, upon completion of the exercise, the user would again generally pull the cord (109) upon completion of their exercise to power down the exercise machine by again breaking the circuit between the clips (103) from movement of the shunt (105).

FIGS. 7-12 provide a second embodiment of the safety mechanism (100). This embodiment is quite similar to the first, except there is no reset button (113) as it is replaced by a fixed shaft (117) having a major face (115) which is generally of similar construction and appearance to the button (113), but is in fixed relationship to the main body (101). Superficially, as can be best seen by comparing FIG. 4 to FIG. 10, the structure of this second embodiment is the same as the first embodiment. However, as can be best seen by comparing FIGS. 5 and 6 to FIGS. 11 and 12, the shaft (117) is not moveable relative to the main body (101) as it is fixed into position by the elongation of the mounting block (313) removing the confined movement area that the button (113) can move within, and with the removal of spring (131) (although removal of the spring (131) is not strictly necessary as the shaft (117) would still be unable to move even if it was present).

Figure 6:
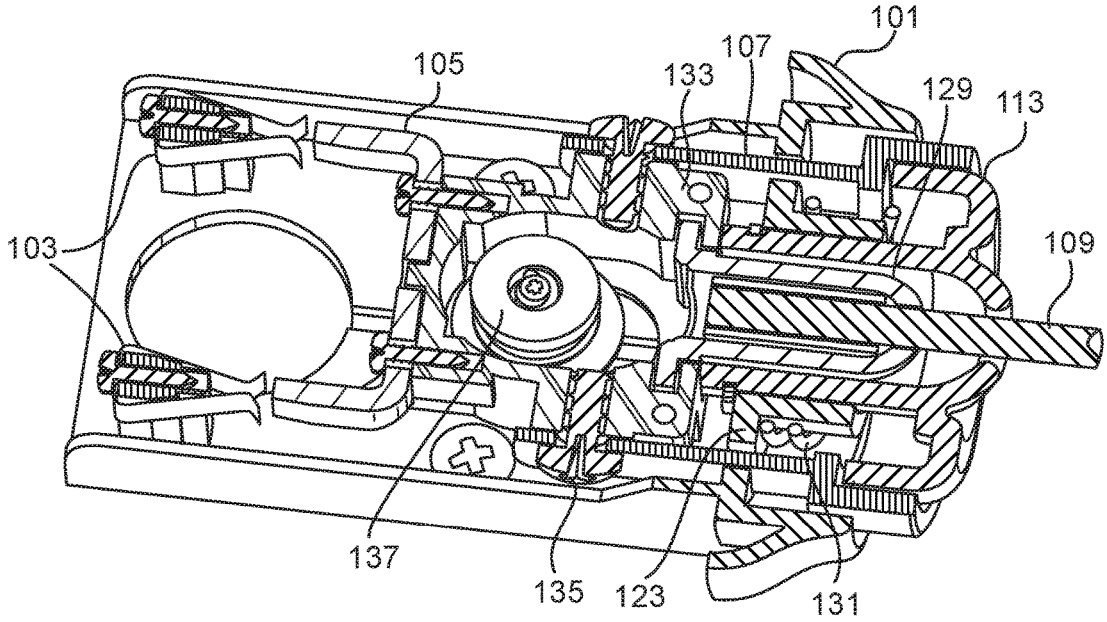
FIG. 6 shows a top cutaway view of the electrical trip mechanism of FIG. 3.
Figure 7:
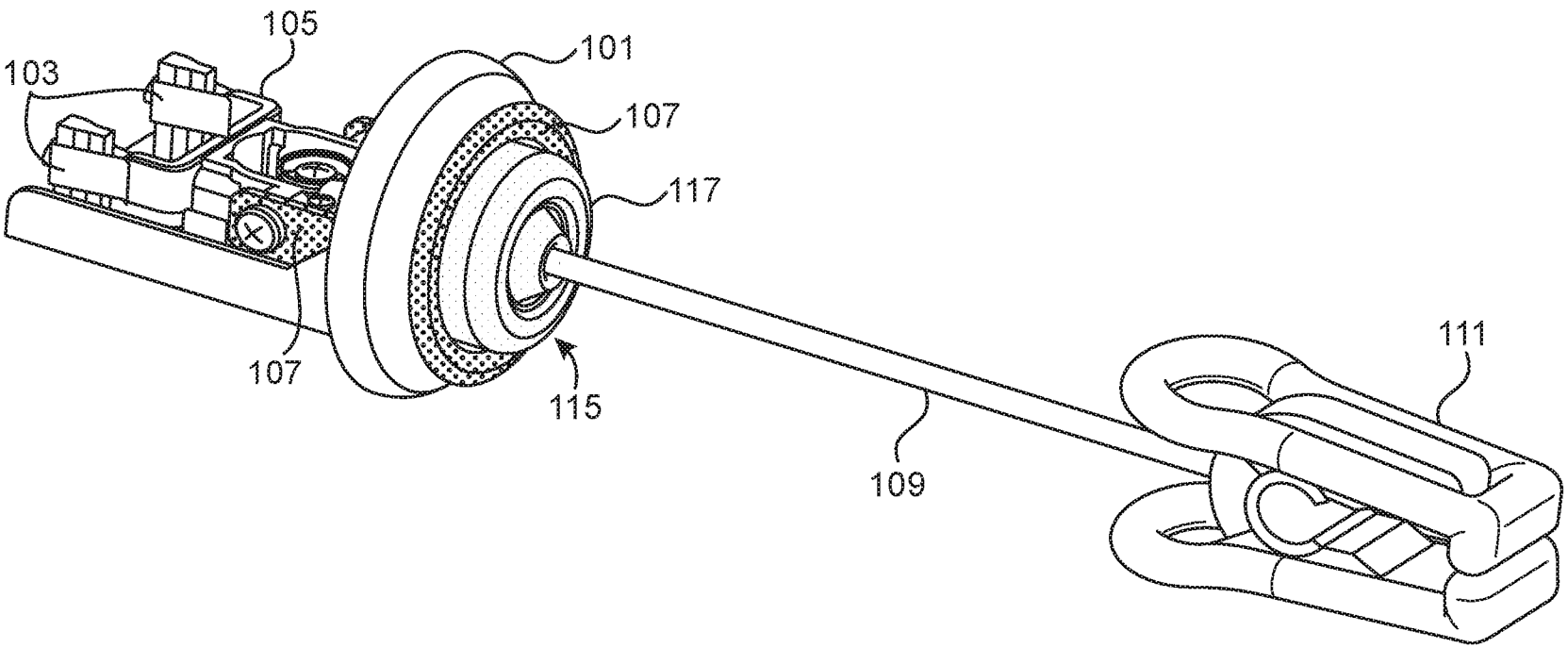
FIG. 7 shows a front perspective view of a second embodiment of a captive cord safety mechanism separated from an exercise device.
Figure 8:
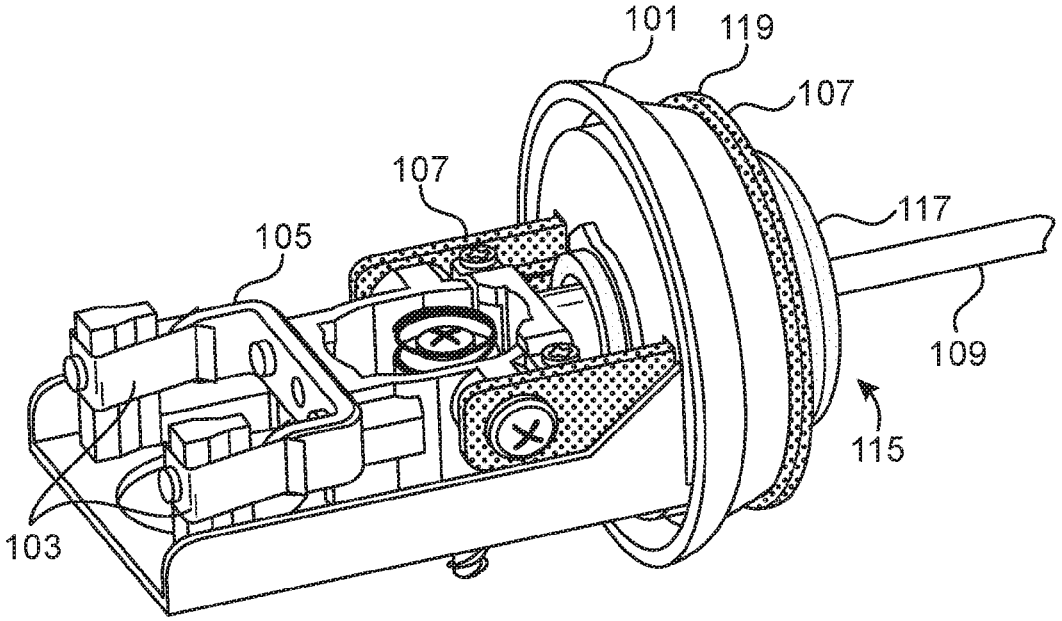
FIG. 8 shows a side perspective view of the electrical trip mechanism of FIG. 7 in the closed (power) position.
Figure 9:
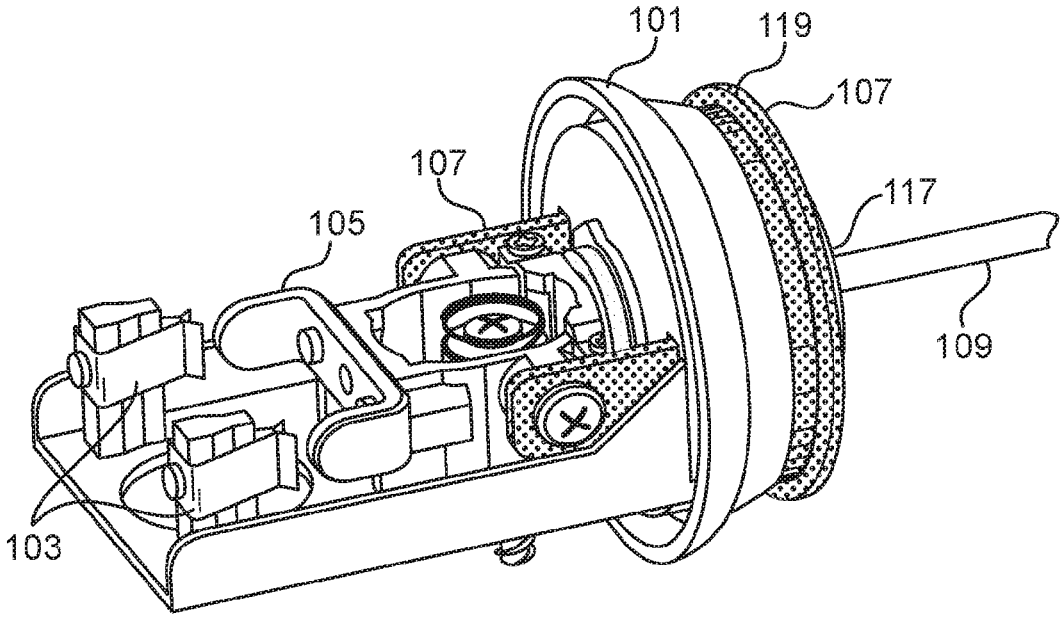
FIG. 9 shows a side perspective view of the electrical trip mechanism of FIG. 7 in the tripped (no power) position.
Figure 11:
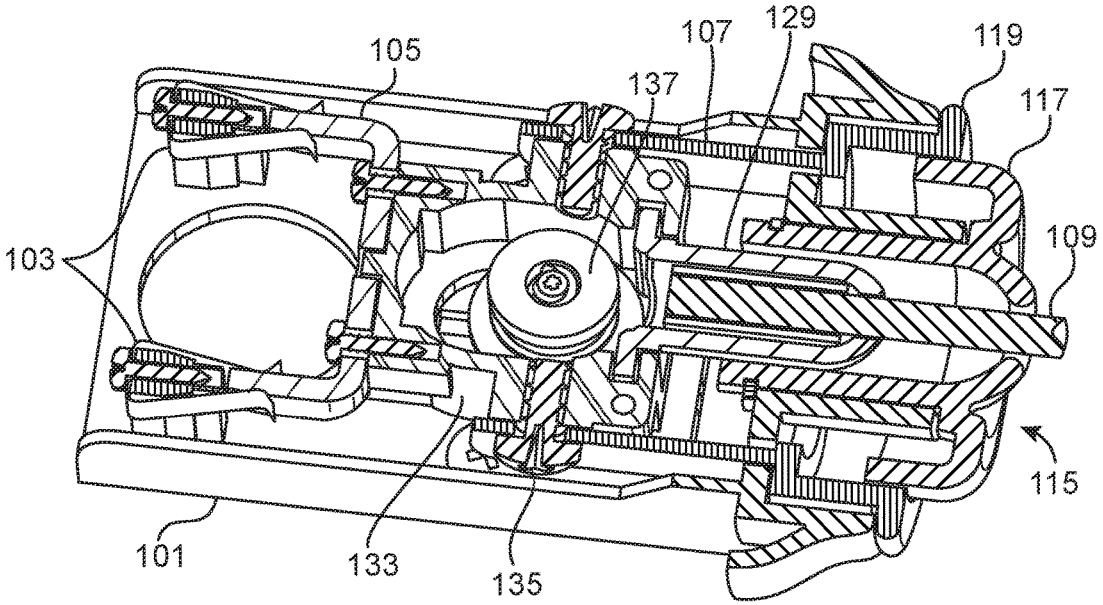
FIG. 11 shows a top cutaway view of the electrical trip mechanism of FIG. 8.
Figure 12:
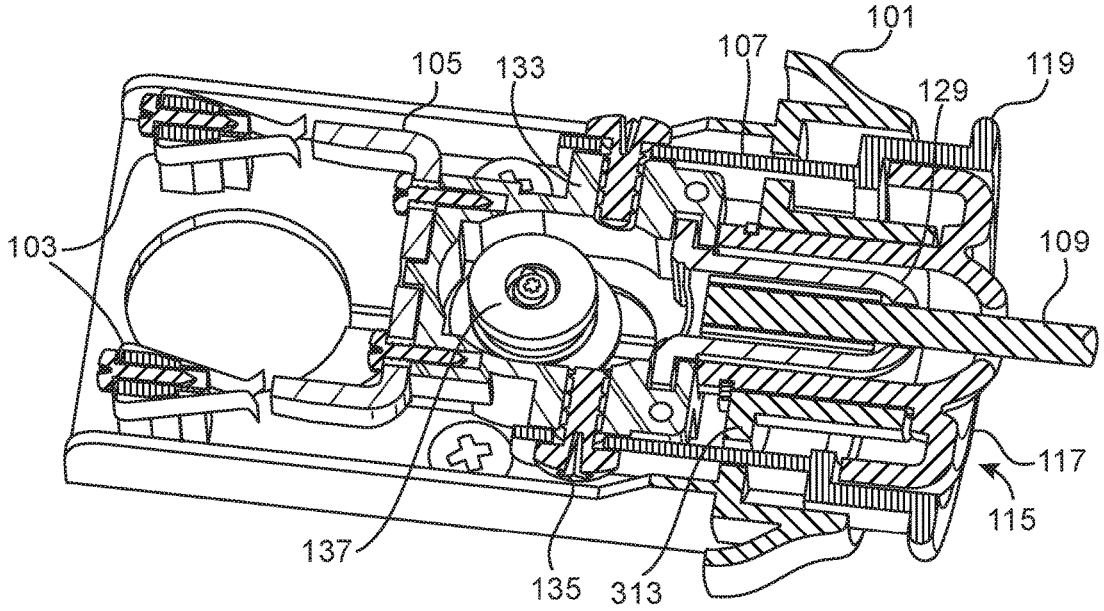
FIG. 12 shows a top cutaway view of the electrical trip mechanism of FIG. 9.

As is shown best in FIGS. 11 and 12, the shaft (117) is now held in a fixed position as opposed to having the constrained area of movement that was present in the embodiment of FIGS. 5 and 6. The shaft (117) still generally extends substantially from the body (101) as is the case with the button (113) when it is not actually depressed and it may be of similar coloration and construction as the button (113). In effect, the shaft (117) may be identical to the button (113) except for being constrained to having little to no movement.

When this second embodiment is tripped, the cord (109) will again pull the peg (129) which pulls the shuttle (133). This in turn causes the shunt (105) to separate from the connectors (103) and pushes the indicator (107) ring (173) to its forward position generally obscuring at least a portion of the shaft (117). Again, in this second embodiment, the ring (173) will generally cover the sides of the shaft (117). Thus, operation of the second embodiment in going from the power position to the trip position is generally identical to the operation of the first embodiment simply with the shaft (117) being positioned in place of the button (113).

However, to reset the safety shutoff device (100), the shaft (117) cannot be pushed as it is generally immoveable relative to the main body (101). Instead, the user in this scenario resets the safety shutoff device (100) to power mode by specifically pushing the indicator's (107) ring (173) back inwards. As the indicator (107) is pushed back, the peg (129) and shuttle (133) also move back into the device and the shunt (105) reengages the clips (103).

To facilitate a user to push the ring (173) back into the main body (101), the ring (173) may include a prominent lip (119) to make it easier to manipulate with the fingers. This lip (119) can also allow a user to grasp the lip (119) directly when the shutoff (100) is in the power position to pull the indicator (107) forward to trip the shutoff (100) and turn off the machine when they are done. This can be done instead of pulling the cord (109) and can result in less wear on the cord (109)

The second embodiment will generally provide for a slightly more complicated reset procedure than the first embodiment and the option of an alternative manual shutoff procedure even while the safety shutoff still occurs the same way. This second embodiment may be preferred in some cases to encourage a user to actually leave the device (100) in the power position which may be desirable in certain circumstances and to inhibit an unintentional transition from the power state to the trip state and vice-versa.

Throughout this disclosure, relative terms such as "generally," "about," and "approximately" may be used, such as, but not necessarily limited to, with respect to shapes, sizes, dimensions, angles, and distances. One of ordinary skill will understand that, in the context of this disclosure, these terms are used to describe a recognizable attempt to conform a device to the qualified term. By way of example and not limitation, components such as surfaces described as being "generally parallel" will be recognized by one of ordinary skill in the art to not be, in a strict geometric sense, parallel, because, in a real world manufactured item, no surface is generally never truly planar as a "plane" is a purely geometric construct that does not actually exist, and no component is truly "planer" in the geometric sense. Thus, no two components of a real item are ever truly parallel, as they exist outside of perfect mathematical representation. Variations from geometric descriptions are inescapable due to, among other things: manufacturing tolerances resulting in shape variations, defects, and imperfections; non-uniform thermal expansion; design and manufacturing limitations, and natural wear.

There exists for every object a level of magnification at which geometric descriptors no longer apply due to the nature of matter. One of ordinary skill will understand how to apply relative terms such as "generally," "about," and "approximately" to describe a range of variations from the literal meaning of the qualified term in view of these and other considerations as well as that use of such mathematical terms is not intended to mean their strict mathematical relationship, but a general approximation of that relationship in the real world.

Further, use in this description of terms such as "forward" and "backward" do not actually require that certain surfaces or objects be closer or further away from a surface at any given time or to denote a necessary arrangement of components or components relative to a user. Instead, they are generally used to denote opposite directions in conjunction with the standard arrangement of the FIGS. provided herein so as to give relative positioning of elements. Similarly, terms such as "inward" and "outward", "left" and "right", and "top" and "bottom" are used to show relative directions or positions as opposed to absolute location relative any other component or a human user or observer.

It will further be understood that any of the ranges, values, properties, or characteristics given for any single component of the present disclosure can be used interchangeably with any ranges, values, properties, or characteristics given for any of the other components of the disclosure, where compatible, to form an embodiment having defined values for each of the components, as given herein throughout. Further, ranges provided for a genus or a category can also be applied to species within the genus or members of the category unless otherwise noted.

While the invention has been disclosed in conjunction with a description of certain embodiments, including those that are currently believed to be the preferred embodiments, the detailed description is intended to be illustrative and should not be understood to limit the scope of the present disclosure. As would be understood by one of ordinary skill in the art, embodiments other than those described in detail herein are encompassed by the present invention. Modifications and variations of the described embodiments may be made without departing from the spirit and scope of the invention.

The invention claimed is:

1. An electrical shutoff for an exercise device, the shutoff comprising:

a main body attached to said exercise device;

a flexible cord attached to a peg at a first end and a clip at an opposing end;

a shuttle attached to said peg;

an electrically conductive shunt attached to said shuttle;

an indicator attached to said shuttle and including a ring;

a button attached to said main body via a spring, said spring biasing said button to a biased position relative to said main body, said button also having a constrained area of movement from said biased position relative to said main body; and at least two electrically conductive clips;

wherein, in a power position, said shunt in placed in electrical contact with said at least two clips so that said shunt completes an electric circuit between said two clips;

wherein, pulling said cord when said shutoff is in said power position, causes said peg to move in a first direction relative to said main body, which in turn causes said shuttle, said shunt, and said indicator to also move in said first direction relative to said main body a sufficient distance to break said electric circuit between said two clips and place said shutoff in a tripped position but without separating said peg, said shuttle, said shunt, and said indicator from said main body;

wherein, when said shutoff is in said tripped position, said ring obscures at least a portion of said button;

wherein, to return said shutoff to said power position from said tripped position, said button is pushed against said spring from said biased position to another position within said constrained area of movement which causes said shuttle, said peg, said shunt, and said indicator to move in a direction opposite said first direction relative to said main body and returns said shunt to completing said electric circuit between said at least two clips; and wherein, after said pushing is complete, said spring biases said button back to said biased position without breaking said electrical connection between said at least two clips.

2. The shutoff of claim 1 wherein said ring obscures a side of said button.

3. The shutoff of claim 1 wherein said ring is a different color to said button.

4. The shutoff of claim 1 wherein said exercise device is a treadmill.

5. The shutoff of claim 1 wherein said clip is configured to attach to clothes.

6. An electrical shutoff for an exercise device, the shutoff comprising:

a main body attached to said exercise device;

a flexible cord attached to a peg at a first end and a clip at an opposing end;

a shuttle attached to said peg;

an electrically conductive shunt attached to said shuttle;

an indicator attached to said shuttle and including a ring;

a shaft attached to said main body; and at least two electrically conductive clips;

wherein, in a power position, said shunt in placed in electrical contact with said at least two clips so that said shunt completes an electric circuit between said two clips;

wherein, pulling said cord when said shutoff is in said power position, causes said peg to move in a first direction relative to said main body, which in turn causes said shuttle, said shunt, and said indicator to also move in said first direction relative to said main body a sufficient distance to break said electric circuit between said two clips and place said shutoff in a tripped position but without separating said peg, said shuttle, said shunt, and said indicator from said main body;

wherein, when said shutoff is in said tripped position, said ring obscures at least a portion of said shaft; and wherein, to return said shutoff to said power position from said tripped position, said ring is pushed in a direction opposite to said first direction which causes said shuttle, said peg, said shunt, and said indicator to move in a direction opposite said first direction relative to said main body and returns said shunt to completing said electric circuit between said at least two clips.

7. The shutoff of claim 6 wherein said ring obscures a side of said shaft.

8. The shutoff of claim 6 wherein said ring is a different color to said shaft.

9. The shutoff of claim 6 wherein said exercise device is a treadmill.

10. The shutoff of claim 6 wherein said clip is configured to attach to clothes.

* * * * *